United States Patent [19]

Zuccato

[11] Patent Number: 4,810,240

[45] Date of Patent: Mar. 7, 1989

[54] CENTRIFUGAL SEPARATOR OF LIQUIDS WITH ROTATING SEALS ON THE FIXED UPPER HEAD

[75] Inventor: Remo Zuccato, Chiuppano, Italy

[73] Assignee: Frau S.p.A., Carre Vicenza, Italy

[21] Appl. No.: 116,524

[22] Filed: Nov. 3, 1987

[30] Foreign Application Priority Data

Nov. 5, 1986 [IT] Italy ..... 85629 A/86

[51] Int. Cl.[4] ..... B01F 15/02; B01F 11/00

[52] U.S. Cl. ..... 494/14; 277/74; 277/75; 277/81 R; 494/41

[58] Field of Search ..... 494/13, 14, 38, 39, 494/40, 41, 27–30, 85; 210/360.1, 781, 782; 366/148, 149, 144; 277/74, 75, 81 R

[56] References Cited

U.S. PATENT DOCUMENTS

| | | | |
|---|---|---|---|
| 3,519,201 | 7/1970 | Eisel | 494/14 |
| 3,640,330 | 2/1972 | Javet | 494/14 |
| 4,011,972 | 3/1977 | Pederson | 494/14 |
| 4,377,253 | 3/1983 | Bruneel | 494/14 |

*Primary Examiner*—Robert W. Jenkins

*Attorney, Agent, or Firm*—Bucknam and Archer

[57] ABSTRACT

The centrifugal separator is provided with an inlet (1) for the liquid in the center, two exits (4 and 5) for the two phases of different density, rotating seals (13,14,15 and 21) which on contact with rings (10,11,12 and 19) resiliently fixed to the fixed upper part of the separator, guarantee a perfect separation of the liquid and the cooling water under pressure.

3 Claims, 2 Drawing Sheets

CENTRIFUGAL SEPARATOR OF LIQUIDS WITH ROTATING SEALS ON THE FIXED UPPER HEAD

The present invention relates to apparatuses for the centrifugal separation of liquids, and more specifically to an apparatus intended for use in the milk industry, although the apparatus may also be used for mixtures of mineral oils, vegetable oils and other liquid mixtures in which liquids are separated into their components of different density under the action of the centrifugal force.

Centrifugal separators for the purpose of achieving the above objects have been known for a long time, but they present some drawbacks which seriously reduce the possibility of usage. The drawbacks are:

(1) substantial turbulence is caused at the point of entry of the liquid in the centripedal pumps;

(2) the impossibility of operating with liquids containing a gas or liquids under pressure;

(3) contact of the liquid mixture with the ambient air, a fact which may cause a pollution of the liquid.

A centrifugal separator according to the present invention eliminates all the above-mentioned drawbacks because the transfer of the liquids is always carried out in a closed circuit, without contact with the atmosphere and independently from the physical state of the product. The evacuation of the two liquids after they have been separated is achieved under the action of the thrust of the pump which feeds the liquid at the inlet and through conduits of constant cross-section, a fact which permits to achieve the transfer of the liquids without turbulence, and under the desired pressure simply by adjusting the latter to the pressure of the pump being used.

The invention is described in more detail by reference to the accompanying drawings of which:

Figure 1:
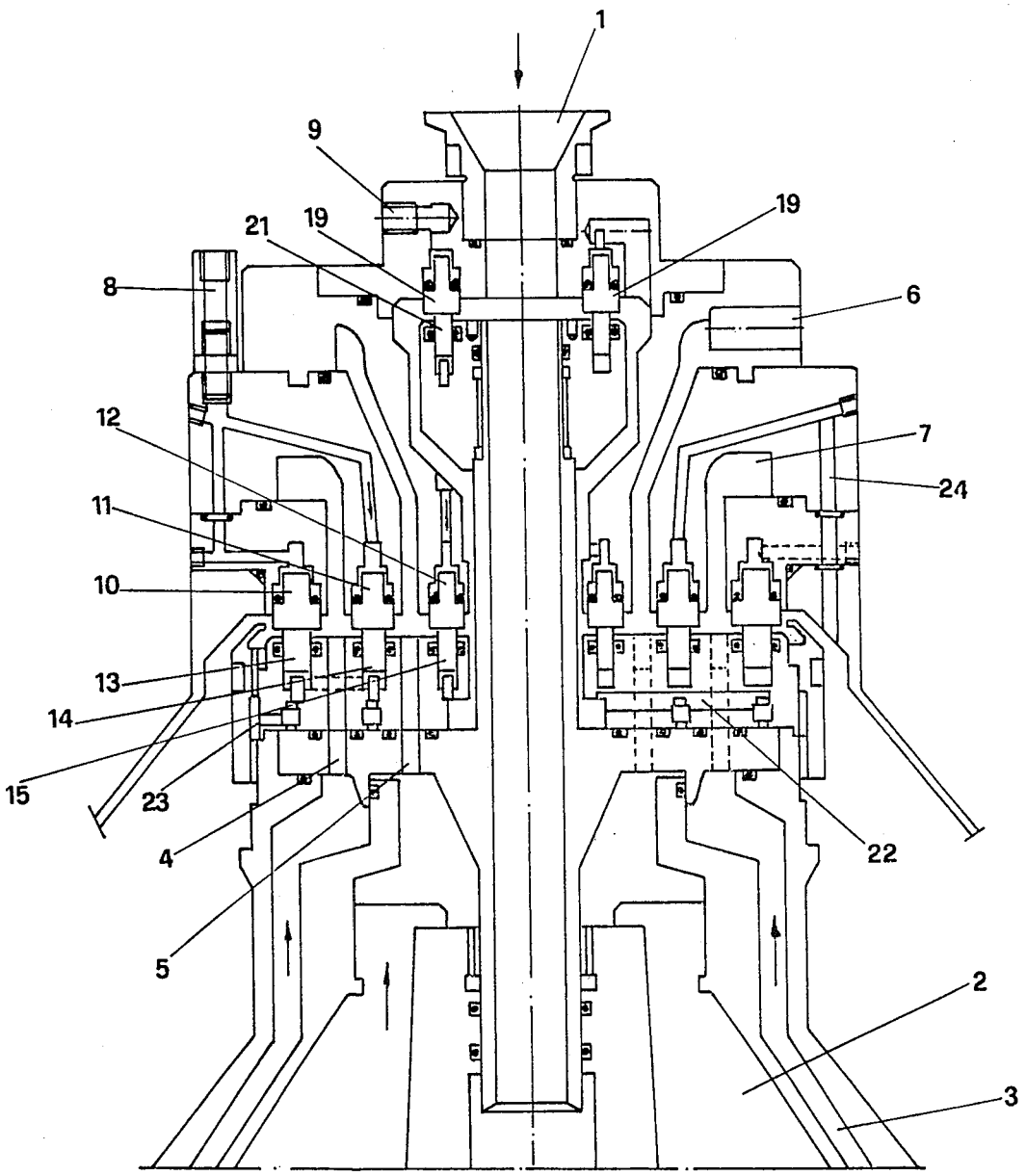
FIG. 1 illustrates a vertical axial cross-section of the head of a centrifugal separator provided with rotating seals according to the invention at the point corresponding to the cooling conduits.

As shown in FIG. 1, the liquid being treated is introduced through the central inlet orifice 1 and goes into roto-separator 2. Hollow space 3 is provided around the walls of the latter and the heavier liquid phase goes through this space and then goes through conduit 4. The lighter phase goes up in the center of the roto-separator through conduit 5 and exits from the outlet orifice 6. In a similar fashion the heavier phases after reaching the annular crown 7 are removed though an outlet not shown in the figure.

Figure 2:
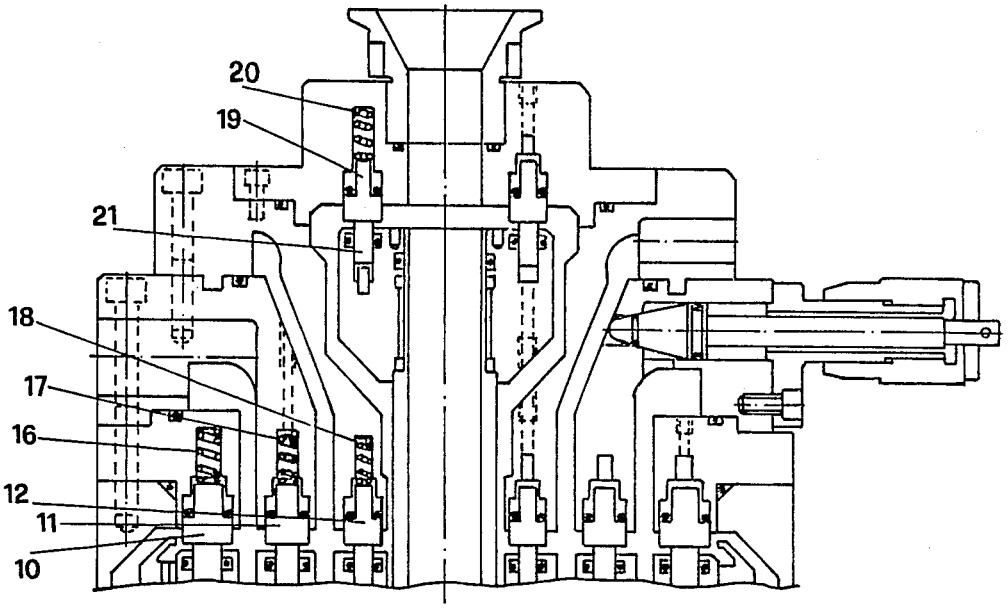
FIG. 2 is a vertical axial section corresponding to the rotating seals and to the channels of evacuation and also of the valves which permit mixing.

The cooling liquids usually water under pressure, is introduced through the inlet nozzles 8 and 9 and laps in the upper part of the apparatus the fixed sealing rings 10, 11, and 12. The latter operate in opposition to the rotating sealing rings 13, 14 and 15, which are suspended from springs 16, 17 and 18 as shown in FIG. 2.

The rotating seal corresponding to the inlet tube 1 is achieved by means of ring 19, which is kept in contact with ring 21, by means of springs 20, the ring 21 being located on the upper part of the rotating part of the apparatus.

The water under pressure introduced through the inlet 9 contributes to cool also ring 19. The cooling water introduced within the inlet 9 after cooling the fixed ring 19 and the movable ring 21 provides also for cooling through conduit 22 both the internal ring 15 as well as the intermediate ring 14 and the external ring 13.

The cooling water is discharged through conduit 23 in a suitable collector not shown in the figure at the end of the cycle. The water under pressure which enters through conduit 8 cools, as already mentioned hereinabove, the external conduit 10 and the intermediate conduit 11 and is discharged to the outside by means of the conduit 24.

It is clear from the foregoing that the essential features of the invention are the presence of the sealing rings 10, 11, 12, and 19 which are resiliently hooked to the fixed head of the apparatus and the sealing rings 13, 14, 15 and 21 which operate in opposition to the rings 10, 11, 12 and 19, and further the fact that the sealing rings 13, 14, 15 and 21 which rotate together with the rotating body of the roto-separator.

The rotating seals in this manner avoid all contacts both of the liquid introduced into the roto-separator, as well as the two liquid phases which are separated in the apparatus with the external atmosphere. This fact guarantees against eventual pollution, particularly in the case of alimentary products such as milk.

A further essential characteristic of the invention is that the cooling water introduced under pressure in the inlet conduits located on the fixed head of the apparatus circulates both at the level of the sealing rings resiliently hooked to the fixed part of the apparatus, as well as at the level of the rotating seals which are disposed on the movable part of the apparatus and provide for cooling also the rotating rings without coming in contact with the liquid being worked due to the different pressure.

The advantages according to the present invention are clear both with respect to the good separation of the liquids which constitute the mixture, as well as with respect to the guaranty against pollution which would result from contact with the atmospheric air.

What is claimed is:

1. A centrifugal separator for separating the component of low density from the component of higher density of a liquid, which comprises a rotating body (2), an inlet for the liquid to be separated into its components, said separator having a fixed part in the upper portion thereof, a conduit (3) surrounding said rotating body for passage of the component of higher density, means for passing said liquid component of lower density through the center of said roto-separator, first outlet means for said liquid of higher density and second outlet means for said liquid of lower density, first sealing rings (10,11,12,19) resiliently fixed to said upper part of said separator, second sealing rings (13,14,15,21) rotating with said rotating body spring means (16,17,18) for urging said first sealing rings in opposition to said second sealing rings.

2. The centrifugal separator according to claim 1 which is provided with means for introducing water under pressure for cooling said fixed sealing rings and said rotating sealing rings, said cooling being achieved without any contact with the liquid phases of the material being worked in said roto-separator.

3. The centrifugal separator according to claim 1 wherein said liquid is whole milk.

* * * * *